US009889359B2

(12) United States Patent
Ouellette

(10) Patent No.: US 9,889,359 B2
(45) Date of Patent: Feb. 13, 2018

(54) BASEBALL PRACTICE BATTING TEE

(71) Applicant: Philip Roland Ouellette, Corona, CA (US)

(72) Inventor: Philip Roland Ouellette, Corona, CA (US)

( * ) Notice: Subject to any disclaimer, the term of this patent is extended or adjusted under 35 U.S.C. 154(b) by 0 days.

(21) Appl. No.: 14/994,397

(22) Filed: Jan. 13, 2016

(65) Prior Publication Data

US 2017/0197130 A1 Jul. 13, 2017

(51) Int. Cl.
*A63B 69/00* (2006.01)
*A63B 71/00* (2006.01)

(52) U.S. Cl.
CPC .. *A63B 69/0002* (2013.01); *A63B 2069/0008* (2013.01); *A63B 2208/0204* (2013.01)

(58) Field of Classification Search
CPC ..... A63B 69/0002; A63B 2069/0008; A63B 2208/0204; A63B 69/0075; A63B 63/00; A63B 69/0091
USPC ..... 473/417, 422, 423, 420, 427, 429, 451
See application file for complete search history.

(56) References Cited

U.S. PATENT DOCUMENTS 1,242,046 A 10/1917 Rogers
2,527,906 A 10/1950 Bennett et al.
3,039,770 A 10/1958 Ferretti
2,976,041 A * 3/1961 White ..... A63B 69/0075 473/417
3,883,138 A * 5/1975 Chorey ..... A63B 69/0075 473/417
4,092,023 A * 5/1978 Hazen ..... A63B 63/00 473/454
4,176,838 A 12/1979 Griffin
4,819,937 A 4/1989 Gordon
5,004,234 A * 4/1991 Hollis ..... A63B 69/0075 473/417
5,100,134 A * 3/1992 Becker ..... A63B 69/0075 473/417
5,386,987 A * 2/1995 Rodino, Jr. ..... A63B 69/0075 473/417
5,427,369 A * 6/1995 Baguet, Jr. ..... A63B 69/0091 473/429
5,601,286 A * 2/1997 Fierbaugh ..... A63B 69/0091 473/429
5,611,539 A * 3/1997 Watterson ..... A63B 61/02 473/428
5,897,444 A * 4/1999 Hellyer ..... A63B 69/0075 473/417
7,226,372 B2 6/2007 Flanigan
(Continued)

*Primary Examiner* — Mitra Aryanpour
(74) *Attorney, Agent, or Firm* — Kirk A. Buhler; Buhler & Associates

(57) ABSTRACT

Improvements in a baseball practice batting tee that allows a person to strike a baseball off the top of the tee. The height of the tee can be from one or more adjustment mechanisms. The mechanism can be from finite detents with a pin in a hole or from a shaft frictionally being maintained in the tube. The top of the batting tee is formed with a spiral ridge to slightly rotate when a ball is struck off the top of the tee. The rotation allows the impact forces from impact with a baseball bat to be distributed from different directions on the top of the tee. The height adjustment is with an expandable washer that slides in a honed tube that has a constant diameter along the length of the tube to maintain a constant force to maintain the height of a ball.

13 Claims, 4 Drawing Sheets

(56) References Cited

U.S. PATENT DOCUMENTS

| | | | | |
|---|---|---|---|---|
| 7,354,360 | B1 * | 4/2008 | Eckstein | A63B 69/0002 473/417 |
| 8,109,844 | B1 | 2/2012 | Quinn | |
| 8,747,258 | B2 | 6/2014 | Durham et al. | |
| 8,821,322 | B1 * | 9/2014 | Jorgens | A63B 69/0075 473/417 |
| 8,905,867 | B2 | 12/2014 | Keller | |
| 8,979,681 | B1 * | 3/2015 | Murphy | A63B 69/0002 473/417 |
| 9,011,278 | B2 * | 4/2015 | Lay | A63B 71/022 473/422 |
| 9,050,516 | B2 | 6/2015 | Holland et al. | |
| 2005/0003908 | A1 * | 1/2005 | Smull | A63B 69/0002 473/419 |
| 2008/0064534 | A1 * | 3/2008 | Lortscher | A63B 69/0002 473/417 |

* cited by examiner

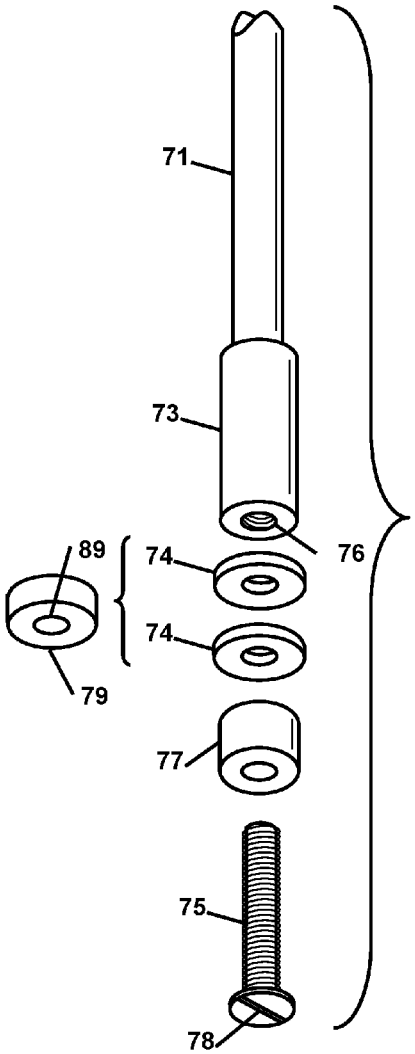
FIG. 5
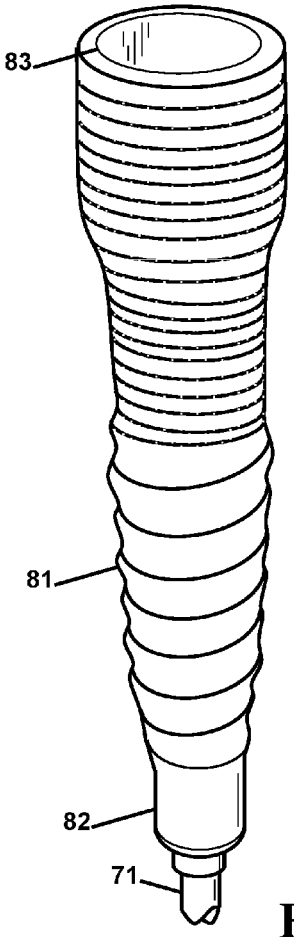
FIG. 6
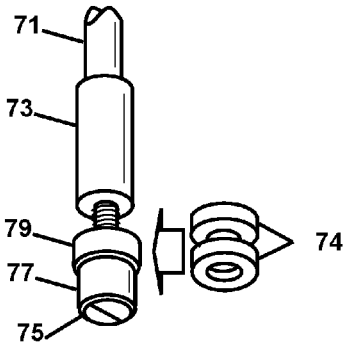

BASEBALL PRACTICE BATTING TEE

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in baseball practice batting tee. More particularly, the present baseball practice batting tee allows a person to practice hitting a baseball without the ball being "pitched" to them. The baseball practice batting tee elevates and holds the baseball at the elevated position where it can be struck with a bat.

Description of Related Art Including Information Disclosed Under 37 CFR 1.97 and 1.98

A batting tee allows a person to practice hitting a baseball or similar object with a bat, stick or club. The ball is held at a fixed elevation above the ground where a batter can practice striking the ball. While the elevation can be adjusted, the elevation above the ground provides a fairly consistent position whereby a person can practice hitting and adjusting their swing without the inconsistencies of the ball being thrown to them.

Simple ball practice mechanism can range from a ball suspended from a string or a pipe or spring that rises from the ground. A number of patents and or publications have been made to address these issues. Exemplary examples of patents and or publication that try to address this/these problem(s) are identified and discussed below.

One of earliest batting Tees is found in U.S. Pat. No. 1,242,046 that issued on Oct. 2, 1917. This patent is for a Base Ball Game where an adjustable Tee is used with a baseball and the object of the game is to bat the baseball from the Tee through targets. While this patent discloses a batting Tee it is secured to a game and is not portable.

U.S. Pat. No. 8,109,844 issued on Feb. 7, 2012 to Thomas A. Quinn discloses a Ball Tee for Batting Practice. The ball Tee has a ball receiver on an upper tube that is secured to a vertically adjustable middle tube that is adjustable with detents on a lower tube on a flexible base. When a ball is struck, the upper tube and the base bends to absorb the impact allow the ball to travel. While this patent provides a batting Tee, the flexing of the base allows the batting Tee to move as each ball is struck.

U.S. Pat. No. 9,050,516 issued on Jun. 9, 2015 for Allen Holland et al., discloses a Spring-Back Ball Tee for Batting Practice. The ball tee for batting practice has a base assembly including a base, a post cup pivotally attached to the base, and at least one spring biasing the post cup into an upright position. The entire upright portion of bends on the base to release ball as opposed to the base staying stationary and just the top flexing.

What is needed is a baseball practice batting tee that is easily adjusted for height and the top portion of the tee rotates to reduce stresses at a single side of the top of the tee. The baseball practice batting tee proposed in this document provides the solution.

BRIEF SUMMARY OF THE INVENTION

It is an object of the baseball practice batting tee to allow a person to strike a baseball off the top of the tee. This allows a person to set the height of a baseball on the tee and to practice hitting the ball at a constant height above the ground. The tee can be fabricated in different heights to accommodate young athletes starting in the sport of baseball to tall experienced athletes.

It is an object of the baseball practice batting tee to have an adjustable height. The height adjustment can be from one or more adjustment mechanisms. The mechanism can be from finite detents with a pin in a hole or from a shaft frictionally being maintained in the tube.

It is an object of the baseball practice batting tee for the top of the batting tee to rotate when a ball is struck off the top of the tee. The rotation allows the impact forces from impact with a baseball bat to be distributed from different directions on the top of the tee. This reduces fatigue and repetitive bending stresses from only one direction to the circumference of the top of the batting tee.

It is another object of the baseball practice batting tee to have a flexible head. The flexible head is formed with a spiral ridge. The spiral ridge prevents folding of the head at only one point. The spiral ridge further imparts a slight rotation to the shaft as flexible head bends forward or backward from the impact of the ball. The flexible head is elongated to allow for an elongated length where an athlete can miss a ball and impact the flexible head without harming the rigid parts of the tee.

It is still another object of the baseball practice batting tee to have adjustability for retention at least one of the height adjustment. The adjustability by expanding the diameter of a washer by squeezing the washer. The washer and shaft slides in a honed tube that has a constant diameter along the length of the tube to maintain a constant force to maintain the height of a ball.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 5 shows exploded view of the bottom of the riser shaft.

FIG. 6 shows a broken detail view of the riser shaft.

DETAILED DESCRIPTION OF THE INVENTION

Figure 1:
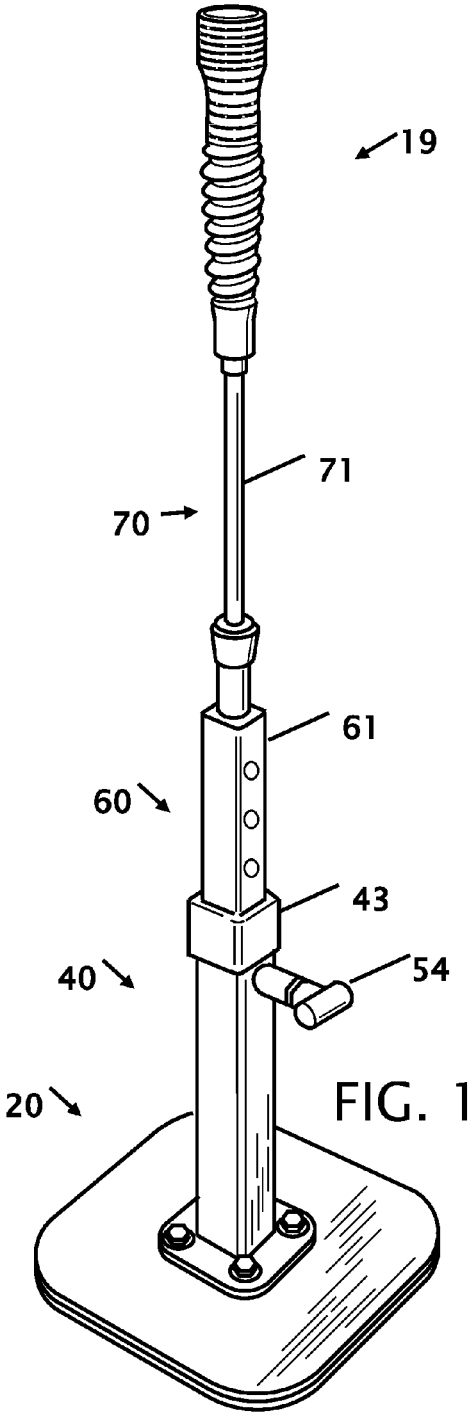
FIG. 1 shows a tall baseball practice batting tee.

FIG. 1 shows a tall baseball practice batting tee 19. This batting tee 19 has two height adjustment elements. The lower element has a base plate 20 with a post section 40 bolted to the base plate 20. A slide tube 60 slides inside of the post section 40. A "T" handle 54 on a pull pin removes a pin from holes in the slide tube 60. This allows for finite positioning of the outer box formed from a square cross-section tube 61 in the slide tube 60 that telescopes inside of the post section 40. A post cap 43 has an opening for the slide tube 60 to pass into the post section 40 and also seals the top of the post section 40 from dust or other debris from entering into the post section 40.

A shaft 71 on the riser section 70 provides a second adjustment section that is not restricted to finite positions. The shaft 71 can be lifted or lowered into the slide tube 60. The compound telescoping sections allow the batting tee 19 to be lowered to a smaller dense package for transportation. The compound telescoping sections also allows the batting tee 19 to be extended for nearly any reasonable height of baseball player to practice.

Figure 2:
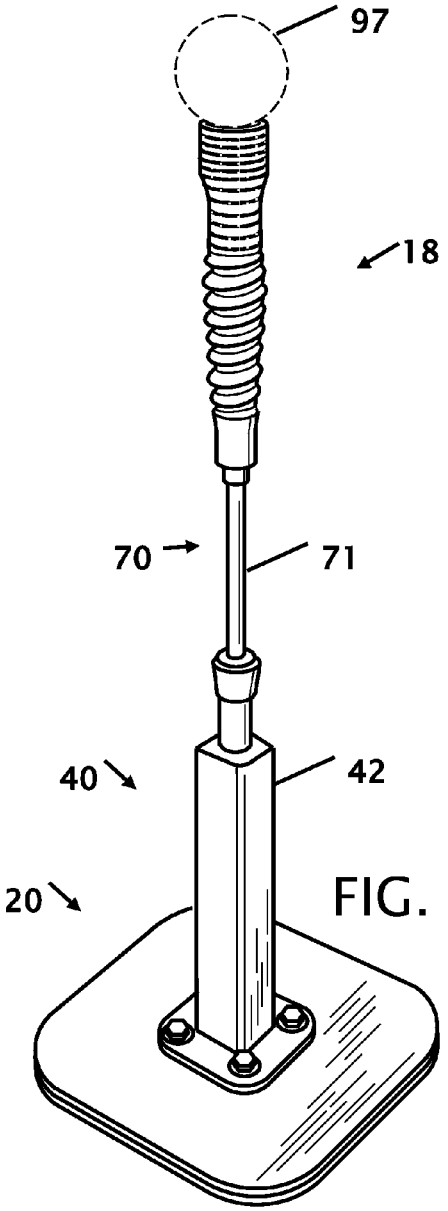
FIG. 2 shows an intermediate baseball practice batting tee.

FIG. 2 shows an intermediate baseball practice batting tee 18. This is an intermediate height, but a lower height can also be constructed where the post section (and the shaft 71) are about half the shown height to allow starting baseball athletes to practice. In this embodiment, the shaft 71 on the riser shaft section 70 can be slid inside of the post section 40 of the post tube 42 to adjust the practice height of the baseball 97. While a baseball is shown and described, other objects can be placed on the batting tee, as well as other striking implements can be used with the batting tee. The base 20 is essentially unchanged between all the embodiments of the batting tees. The base 20 remains stationary while practicing and only the upper portion of the riser section bends if the top portion of this section is struck with a bat.

Figure 3:
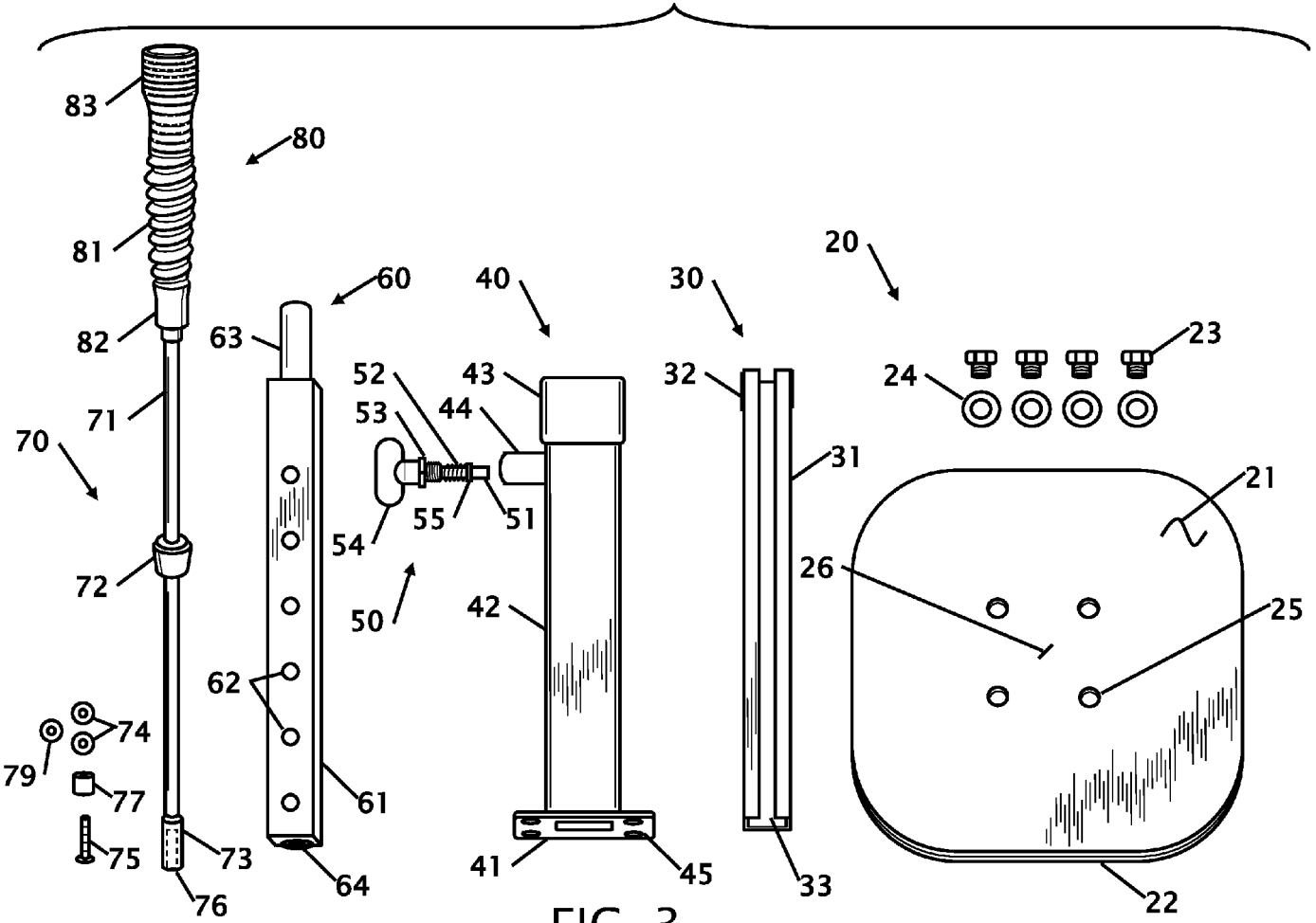
FIG. 3 shows an exploded view of the baseball practice batting tee.

FIG. 3 shows an exploded view of the baseball practice batting tee. The base plate 20 is essentially a rounded square or a rounded rectangular shape made of steel or other equivalent material. The base plate 21 has a flat bottom and the bottom of the base plate 21 has a plastic, rubber or elastomeric covering that both protects the underlying surface and also reduces movement of the baseball tee. A plurality of tapped holes 25 are used to secure the remainder of the baseball tee, or more specifically the post section 40. Fasteners 23 pass through washers 24 and or lock washers and then through holes 45 in the post section and then a secured in the tapped holes 25.

A guide section 30 is placed within the post section 40 to eliminate rattle and provide smooth motion of the slide tube section 60 in and out of the post section. The guide section 30 has an essentially square cross-section with a slot 33 passing down one side of the guide tube 31. The slot 33 provides for clearance of a pin 51 that stops motion of the slide tube section 60. Two lengths of felt, or other cushioning/bearing material 32 are on the insides of the guide tube 31 and wrap at least partially around and down the outside of the guide tube 31. This wrap-around feature prevents the edge of the material 32 from being pulled into the center of the guide tube 31 when the slide tube 60 is placed into the top of the post section 40

The post section 40 has a post base 41 with a plurality of holes 45. These holes are for securing bolts or screws 23 to secure the post section 40 into the tapped holes in the base plate 21. The post tube 42 is essentially a square cross-sectional tube and is welded or otherwise secure to the post base 41. A post side tube 44 is welded to the side of the post tube 42. In some embodiments the post side tube 44 is not needed when the slide tub section 60 is fixedly secured to the post 40 or the base plate 21. A post cap 43 has an opening for the slide tube 60 to pass into the post section 40 and also seals the top of the post section 40 from dust or other debris from entering into the post section 40.

The pull pin 50 has a T handle 54 that is withdrawn to retract a pin 51. While a T handle is shown and described, the shape of the handle can take different configurations and shapes. Adjacent to the T handle 54 is a hollow bolt 53 where the shaft of the T handle passes. A compression spring 52 keeps the pin 51 engaged into a hole 62 in the slide tube 60 or onto the side of the slide tube where motion of the slide tube will engage the pin 51 into a hole 62 in the slide tube 60. A keeper 55 retains the compression spring 52 on the pull pin 50.

The slide tube section 60 is a middle section (in some configurations) in the baseball tee. This slide tube section 60 provides incremental movement of the slide tube section 60 in the post section 60 and allows the riser shaft to move within the slide tube section 60 with restrained movement. The slide tube section is essentially constructed with an inner central tube 63 being a round cross-section tube that is welded within an outer box formed from a square cross-section tube 61. The two tubes 61 and 63 are essentially welded flat at one end and the inner tube 63 is welded to protrude from the square cross-section tube 61 at the other end. A plurality of holes 62 are drilled, punched or otherwise formed in the side of the square tube 61. These holes 62 provide stopping locations for the pull pin 51 to engage into to provide finite stopping locations. After the two tube sections 61 and 63 are welded together a central hole 64 is reamed through the round tube to provide a constant and round bearing surface.

The riser shaft section 70 is an elongated shaft 71 that slides and is retained within the center tube 63 of the slide tube 60. The bottom of the riser shaft section 70 has a shaft guide 73 with a tapped hole 76 in the bottom of the shaft guide 73. The tapped hole secures a screw 75. A washer tube 77 and one or more elastomeric washers/rings or guides 74 are secured with the screw 75 into the shaft guide 73. As the screw 75 is tightened, the outside diameter of the guides 74 enlarges. The enlarged diameter forces the washers 74 against the inside diameter hole 64 of the center tube 64. The head on the screw 76 can be slotted, Philips, hex or other shape. It is contemplated that a driver head 26 can be incorporated into the base plate 21. This will allow a user to lower the riser shaft section 70 into the bottom of the baseball tee, engage the head of the screw 76 in to driver head 26 and tighten (or loosen) the screw 75 to thereby alter the force to move the riser shaft section 70 within the center tube hole 64. A seal 72 seals the opening between the shaft 71 and the inside diameter 64 of the slide tube 60.

In another contemplated embodiment, the two washers 74 are replaced with a single coated diametrical magnet 79. The coating on the diametrical magnet is plastic, vinyl or other material that creates the friction of the elongated shaft 71 within the center tube 63. The diametrical magnet 79 presses coating against the inside diameter of the center tube 63. The bore of the inside diameter of the center tube 63 is not critical in this embodiment. Further, adjustment of the diametrical magnet 79 is not required in this embodiment.

At the top end of the elongated shaft 71 is the area where a baseball is placed. The elongated shaft 71 connects to a shaft neck 80 transitions from the fairly ridged elongated shaft 71 to the elastomeric flexible head. From the head collar 82 a spiral upright 81 extends. The spiral nature of the elastomeric material imparts slight rotation to the shaft when the elastomeric head is struck. The rotation alters the area of the head that receives the impact from a baseball bat to thereby move the high stress concentration to a different location with every impact. The top of the baseball tee is a receiver cup 83 where a baseball is placed. The outside metal surfaces of the baseball tee are powder coated or similarly coated to prevent or reduce rust or corrosion.

Figure 4:
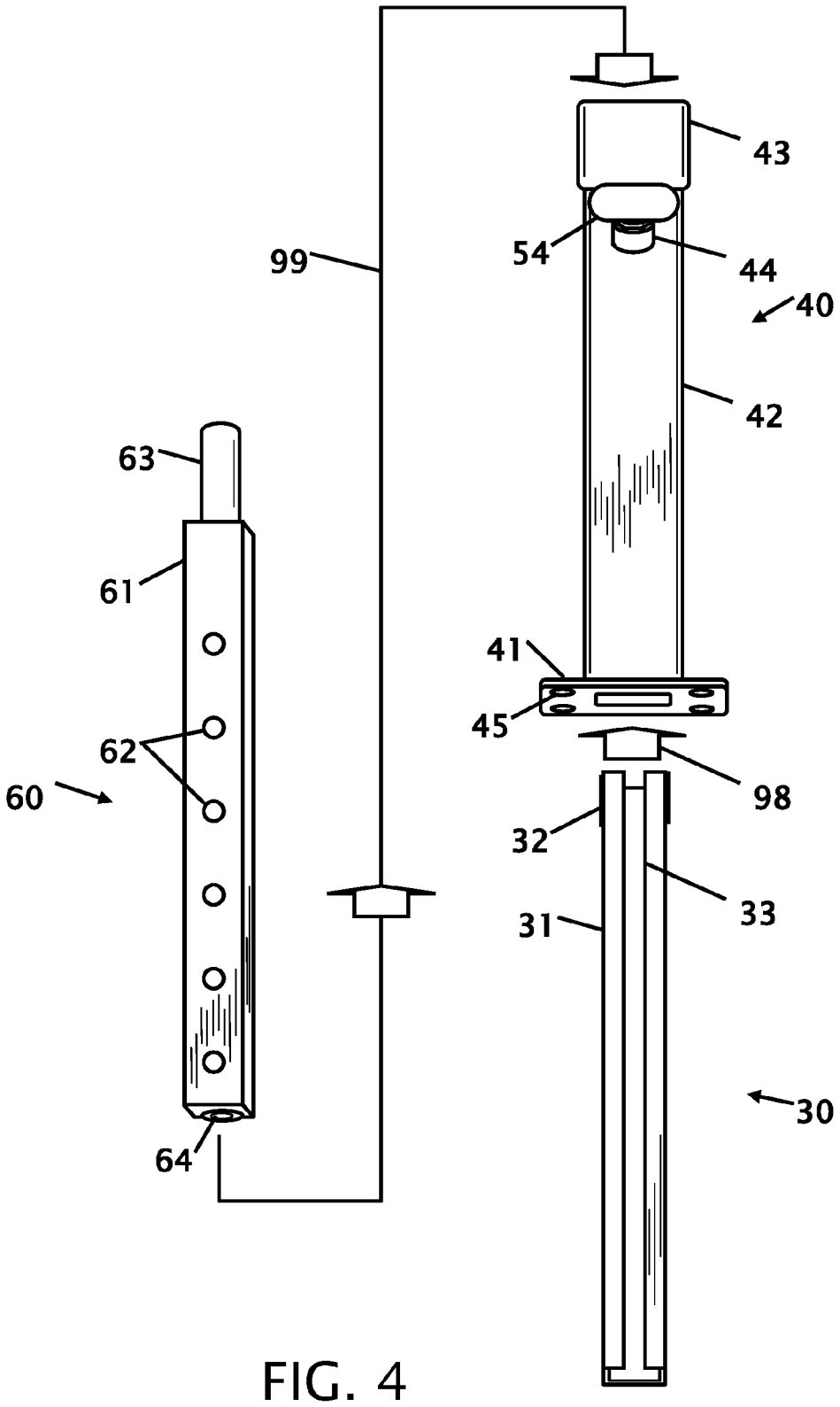
FIG. 4 shows an exploded view of the post and the slide tube.

FIG. 4 shows an exploded view of the post 40 and the slide tube 60 and the direction of assembly of the guide section 30 into 98 the post section 40 and the slide tube into 99 the post section 40. A guide section 30 is placed within the post section 40 to eliminate rattle and provide smooth motion of the slide tube section 60 in and out of the post section. The guide section 40 has an essentially square cross-section with a slot 33 passing down one side of the guide tube 31. The slot 33 provides for clearance of a pin that stops motion of the slide tube section 60. Two lengths of felt, or other cushioning/bearing material 32 are on the insides of the guide tube 31 and wrap at least partially around and down the outside of the guide tube 31. This wrap-around feature prevents the edge of the material 32 from being pulled into the center of the guide tube 31 when the slide tube 60 is placed into the top of the post section 40.

The post section 40 has a post base 41 with a plurality of holes 45. These holes are for securing bolts or screws 23 to secure the post section 40 into the tapped holes in the base plate 21. The post tube 42 is essentially a square cross-sectional tube and is welded or otherwise secure to the post base 41. A post side tube 44 is welded to the side of the post tube 42. In some embodiments the post side tube 44 is not needed when the slide tub section 60 is fixedly secured to the post 40 or the base plate 21. A post cap 43 has an opening for the slide tube 60 to pass into the post section 40 and also seals the top of the post section 40 from dust or other debris from entering into the post section 40. The T handle 54 is withdrawn to retract a pin. While a T handle is shown and described, the shape of the handle can take different configurations and shapes.

The slide tube section 60 is a middle section (in some configurations) in the baseball tee. This slide tube section 60 provides incremental movement of the slide tube section 60 in the post section 60 and allows the riser shaft to move within the slide tube section 60 with restrained movement. The slide tube section is essentially constructed with an inner central tube 63 that is welded within a square cross-section tube 61. The two tubes 61 and 63 are essentially welded flat at one end and the center tube 63 is welded to protrude from the square tube 61 at the other end. A plurality of holes 62 are drilled, punched or otherwise formed in the side of the square tube 61. These holes 62 provide stopping locations for the pull pin 51 to engage into to provide finite stopping locations. After the two tube sections 61 and 63 are welded together a central hole 64 is reamed through the round tube to provide a constant and round bearing surface.

FIG. 5 shows exploded view of the bottom of the riser shaft 71. The bottom of the riser shaft section 70 has a shaft guide 73 with a tapped hole 76 in the bottom of the shaft guide 73. The tapped hole secures a screw 75 with slotted 78 head. A washer tube 77 and one or more elastomeric washers/rings or guides 74 are secured with the screw 75 into the shaft guide 73. As the screw 75 is tightened, the outside diameter of the guides 74 enlarges. The enlarged diameter forces the washers 74 against the inside diameter hole 64 of the center tube 64. Altering the compression on the washer(s) 74 changes the force required to raise and lower the shaft 71 as well as the retention force to maintain the height of a ball on the top of the tee. The alternate embodiment of the washers 74 is shown with a single frictional coated diametrical magnet 79 with a central hole 89 that allows the diametrical magnet 79 to spin on the screw 75. One side of the diametrical magnet is attracted to one-side of the inside diameter of the central tube 63 so the frictional material resists vertical movement of the riser shaft 71 in the central tube 63 but allows free rotation of the riser shaft 71 within the central tube 63.

FIG. 6 shows a broken detail view of the riser shaft 71. The screw 75 and washer 77 is shown retaining the single coated diametrical magnet 79. The optional washers 74 are shown. These component have been previously shown and described in FIG. 5. The elongated shaft 71 connects to a shaft neck 80 transitions from the fairly ridged elongated shaft 71 to the elastomeric flexible head. From the head collar 82 a spiral upright extends. The spiral nature of the elastomeric material imparts slight rotation to the shaft when the elastomeric head is struck. The rotation alters the area of the head that receives the impact from a baseball bat to thereby move the high stress concentration to a different location with every impact. The top of the baseball tee is a receiver cup 83 where a baseball is placed. The outside metal surfaces of the baseball tee are powder coated or similarly coated to prevent or reduce rust or corrosion.

Thus, specific embodiments of a baseball practice batting tee have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A baseball practice batting tee comprising:

a horizontal base plate;

a first vertical rectangular post secured to said horizontal base plate;

said first vertical rectangular post having an internal guide tube sleeve;

a first slider slidably received within said internal guide tube sleeve of said first vertical rectangular post;

said first slider further including a central tube;

an elongated shaft slidably received within said central tube;

said elongated shaft has a second end with at least one compression washer that expands when compressed;

compression of said washer is with a fastener adjustably engaged in said second end of said elongated shaft;

said horizontal base plate includes a driver head that is incorporated into said horizontal base plate whereby said elongated shaft is configured to fit said fastener into said driver head and said elongated shaft is rotated to alter said at least one compression washer to change a sliding resistance between said elongated shaft and said central tube;

said elongated shaft further including a first end topped with a receiver cup;

wherein said receiver cup includes a head collar that transitions to an upright cup having an elastomeric spiral outer ridge, and wherein said spiral nature of the elastomeric spiral outer ridge imparts slight rotation onto said elongated shaft when said receiver cup is struck in a generally perpendicular direction to said elongated shaft.

2. The baseball practice batting tee according to claim 1 wherein said first vertical rectangular post further includes a spring-loaded pull pin.

3. The baseball practice batting tee according to claim 2 wherein said spring loaded pull pin engages into holes in said first slider.

4. The baseball practice batting tee according to claim 1 wherein said internal guide tube sleeve further includes at least one bearing surface.

5. The baseball practice batting tee according to claim 4 wherein said bearing surface is an adhesive backed pad.

6. The baseball practice batting tee according to claim 1 wherein said receiver cup temporarily supports a ball.

7. A baseball practice batting tee comprising:

a horizontal base plate;

a vertical post secured to said horizontal base plate;

a guide section positioned within said vertical post, wherein said guide section includes means for allowing for a smooth frictionless sliding motion within said guide sestion;

a slide tube telescopically received within said guide section and adjustably secured therein, said slide tube including a central bore;

an elongated shaft slidably received within said central bore of said slide tube, wherein said elongated shaft has a first end and a second end;

said first end of said elongated shaft inclds a spiral elastomeric shaft neck with a ball cup;

said second end of said elongated shaft includes a diametrical magnet, said diametrical magnet further includes a coating of frictional material;

wherein said diametrical magnet is attracted to said central bore of said slide tube, whereby said frictional material on said diametrical magnet creates a frictional engagement between said elongated shaft and said central bore of said slide tube thereby reducing linear movement of said elongated shaft within said slide tube.

8. The baseball practice batting tee according to claim 7 wherein an inside diameter of said central slide tube is honed to a constant inside diameter.

9. The baseball practice batting tee according to claim 7 wherein said receiver cup has at least one spiral ridge that extends at least partially along and around said receiver cup.

10. The baseball practice batting tee according to claim 9 wherein said spiral ridge imparts at least some rotation onto said elongated shaft when said cup is struck in a generally perpendicular direction to said elongated shaft.

11. The baseball practice batting tee according to claim 7 wherein said receiver cup temporarily supports a ball.

12. The baseball practice batting tee according to claim 7 wherein said vertical post is removably secured to said horizontal base plate.

13. The baseball practice batting tee according to claim 7 wherein said diametrical magnet has a central hole whereby said diametrical magnet is configured to freely turn on said central hole.

* * * * *